US007005093B2

(12) United States Patent
Ding et al.

(10) Patent No.: US 7,005,093 B2
(45) Date of Patent: Feb. 28, 2006

(54) SPIN ANNEALED POLY(TRIMETHYLENE TEREPHTHALATE) YARN

(75) Inventors: Zhuomin Ding, Blythewood, SC (US); Joe Forrest London, Jr., Mount Ulla, NC (US)

(73) Assignee: E. I. Du Pont de Nemours and Company, Wilmington, DE (US)

( * ) Notice: Subject to any disclaimer, the term of this patent is extended or adjusted under 35 U.S.C. 154(b) by 294 days.

(21) Appl. No.: 10/663,295

(22) Filed: Sep. 16, 2003

(65) Prior Publication Data

US 2004/0151904 A1 Aug. 5, 2004

Related U.S. Application Data

(60) Provisional application No. 60/445,158, filed on Feb. 5, 2003.

(51) Int. Cl.

| | |
|---|---|
| ***D01D 5/088*** | (2006.01) |
| ***D01D 10/02*** | (2006.01) |
| ***D01F 6/62*** | (2006.01) |
| ***D02G 3/02*** | (2006.01) |

(52) U.S. Cl. ..... 264/103; 264/130; 264/211.12; 264/211.14; 264/211.17; 264/234; 264/237

(58) Field of Classification Search ..... 264/103, 264/130, 211.12, 211.14, 211.17, 234, 237
See application file for complete search history.

(56) References Cited

U.S. PATENT DOCUMENTS

| | | | |
|---|---|---|---|
| 3,671,379 | A | 6/1972 | Evans et al. |
| 4,001,190 | A | 1/1977 | Tanikella et al. |
| 5,340,909 | A | 8/1994 | Doerr et al. |
| 5,798,433 | A | 8/1998 | Schmidt et al. |
| 6,153,679 | A | 11/2000 | Kawaji et al. |
| 6,245,844 | B1 | 6/2001 | Kurian et al. |
| 6,312,805 | B1 | 11/2001 | Sun |
| 6,331,264 | B1 | 12/2001 | Kurian et al. |
| 6,335,093 | B1 | 1/2002 | Mori et al. |
| 6,399,194 | B1 | 6/2002 | Kunisada et al. |
| 6,495,254 | B1 | 12/2002 | Abe et al. |
| 6,576,340 | B1 | 6/2003 | Sun et al. |
| 6,620,502 | B1 | 9/2003 | Fujimoto et al. |
| 6,680,353 | B1 | 1/2004 | Kato et al. |
| 2003/0180533 | A1 | 9/2003 | Koyanagi et al. |

FOREIGN PATENT DOCUMENTS

| | | | |
|---|---|---|---|
| EP | 0 699 700 | A2 | 3/1996 |
| EP | 1 142 955 | A1 | 10/2001 |
| EP | 1 172 467 | A1 | 1/2002 |
| EP | 1172467 | A1 | 1/2002 |
| EP | 1 209 262 | A1 | 5/2002 |
| EP | 1209262 | A1 | 5/2002 |
| EP | 1 285 876 | A1 | 2/2003 |
| EP | 1285876 | A1 | 2/2003 |
| JP | 50-71921 | A | 6/1975 |
| JP | 51-47114 | A1 | 4/1976 |

(Continued)

OTHER PUBLICATIONS

English Translation of Asashi's JP 01214372 By Z. Ding.

(Continued)

*Primary Examiner*—Leo B. Tentoni
(74) *Attorney, Agent, or Firm*—Mark D. Kuller

(57) ABSTRACT

A spinning process for poly(trimethylene terephthalate) and an analytical method wherein the process provides an aging resistant poly(trimethylene terephthalate) yarn and the analytical method provides predictability to the process.

22 Claims, 4 Drawing Sheets

FOREIGN PATENT DOCUMENTS

| | | | |
|---|---|---|---|
| JP | 58-31114 | A1 | 2/1983 |
| JP | 8-232117 | A | 9/1996 |
| JP | 8-311177 | A | 11/1996 |
| JP | 2000-239921 | A | 9/2000 |
| JP | 2000239921 | A1 | 9/2000 |
| JP | 2001-020136 | A | 1/2001 |
| JP | 2001020136 | A | 1/2001 |
| JP | 2001-064824 | A | 3/2001 |
| JP | 2001064824 | A | 3/2001 |
| JP | 2001214372 | A | 8/2001 |
| JP | 2001-254226 | A | 9/2001 |
| JP | 2001254226 | A | 9/2001 |
| JP | 2001-279528 | A | 10/2001 |
| JP | 2001279528 | A | 10/2001 |
| JP | 2001-348731 | A | 12/2001 |
| JP | 2001348731 | A | 12/2001 |
| JP | 2002-061038 | A | 2/2002 |
| JP | 2002061038 | A | 2/2002 |
| JP | 2002-129427 | A | 5/2002 |
| JP | 2002129427 | A | 5/2002 |
| WO | WO 00/26301 | A1 | 5/2000 |
| WO | WO 01/85590 | A1 | 11/2001 |

OTHER PUBLICATIONS

International Search Report and Written Opinion (Date of Mailing: Aug. 10, 2004).

SPIN ANNEALED POLY(TRIMETHYLENE TEREPHTHALATE) YARN

CROSS REFERENCE TO RELATED APPLICATION

This application relates to and claims priority benefits from U.S. Provisional Patent Application Ser. No. 60/445,158, filed Feb. 5, 2003, incorporated by reference herein in its entirety.

FIELD OF THE INVENTION

The present invention relates to a polyester yarn and its manufacture. More particularly, the invention is a process to provide poly(trimethylene terephthalate) yarns resistant to aging upon storage, which are suitable for use as feed yarns for post-processing such as drawing and/or draw-texturing and also for direct use in fabrics without further processing.

BACKGROUND OF THE INVENTION

Polyethylene terephthalate ("2GT") and polybutylene terephthalate ("4GT"), generally referred to as "polyalkylene terephthalates", are common commercial polyesters. Polyalkylene terephthalates have excellent physical and chemical properties, in particular, chemical, heat and light stability, high melting points and high strength. As a result they have been widely used for resins, films and fibers.

Polytrimethylene terephthalate ("3GT") has achieved growing commercial interest as a fiber because of the recent developments in lower cost routes to 1,3-propanediol (PDO), one of the polymer backbone components. 3GT has long been desirable in fiber form for its disperse dyeability at atmospheric pressure, low bending modulus, elastic recovery and resilience.

Feeder yarns (also referred to as "feed yarns" herein, such as partially oriented yarn, "POY") are typically prepared by melt-spinning of the starting polymer. Feeder yarns do not have the properties required to make textile products without further drawing or draw-texturing, and therefore, are often subject to storage. During storage, prior to subsequent processing, the feeder yarns often age, resulting in loss of properties. As a feed yarn for draw-texturing or drawing, POY is frequently transported from the fiber producer to mills where the POY is drawn-textured or drawn.

A significant aging problem for 3GT POY yarns generally occurs during the time after the yarn is produced from a spinning machine and before the yarn is processed on a drawing or texturing machine. (In contrast, 2GT yarns do not typically age very rapidly during yarn storage time and thus may remain suitable for downstream drawing or draw-texturing operations after storage times as long as, for example, 3 months.) Aging problems in 3GT yarns are especially evident at elevated temperatures during storage and transportation. For example, temperatures of 38° C. and higher may be experienced by yarns during storage in the summer months in a facility without air-conditioning. POY 3GT yarns stored at temperatures of 38° C. or more may become unsuitable for subsequent processing in less than 24 hours.

EP 1 172 467 A1 discloses a process to manufacture 3GT yarn wherein the spinning process and storage are performed under strict conditions of temperature and humidity, 10–25° C. at a relative humidity of 75–90%. This process is impractical for manufacturers who lack air-conditioned storage facilities in warm climates or who ship the spun yarn via truck or other transportation means that lack air conditioning. EP 1 172 467 A1 further discloses that there is a significant impact of temperature on yarn shrinkage, which results in deformed packages that are unsuitable for subsequent drawing and texturing processes.

Similarly, EP 1 209 262 also discloses a 3GT yarn, which was alleged to be capable of being stored and subsequently textured. The patent alleges that the yarn has improved package winding if the fiber has an orientation as determined by birefringence of 0.030–0.070 and a crystallinity as determined by fiber density of 1.320–1.340 g/cm$^3$. A process is provided to produce such fibers by heat treating (50–170° C.) and crystallizing the fibers during a spinning process and immediately winding at "extremely low tension" (0.02–0.20 cN/dtex). However, the disclosed technology in the patent involves the first godet being cold, the second godet being hot, and the package being immediately wound after the hot godet.

JP02129427 reviews the spin-annealing technology that winds the package immediately after the hot godet. According to JP02129427, direct package winding after a hot godet gives a soft threadline caused by high temperature in the threadline between the heated godet and winder. The soft threadline causes a shaking threadline, resulting in increased spinning break or an increased number of misses in package switchover in auto-doff. In addition, in order to improve the yarn uniformity, reduce spinning break, or reduce missing package switchover in auto-doff caused by soft threadline in the technology, the winding tension between the hot godet and winder has to be increased. This increased winding tension made it impossible to avoid tight package winding. Therefore, the technology of winding a package immediately after a hot godet is not the advanced one, which can manufacture PTT-POY without tight package winding, without spinning break or without missing package switchover.

Both U.S. Pat. No. 6,399,194 and JP 01214372 disclose processes in which 3GT yarns undergo a heat treatment step after quench and application of finish to spun fibers prior to being wound. In these processes, hot yarns are directly wound onto packages to avoid the threadline from passing other godet under low tension before winding.

WO 01/85590 discloses heat treating a non-crystalline yarn during spinning. Because the yarn is amorphous, drawing is applied to allow the threadline to pass the second (cold) godet.

JP02129427 recognizes several of the problems encountered in the earlier patents, and places a cold godet after the hot godet prior to winding.

While it is recognized that aging of 3GT feeder yarns is an issue, it would be desirable to provide a spinning process with few spinning breaks that is capable of producing a yarn in a large package size, such as about 6 kg or above, with high uniformity and with low bulge or dish formation. Furthermore, such a process would be desirable which provides a yarn package having stable package formation and stable yarn properties, that is, where the package does not deform and the yarn properties do not change at high storage temperatures, such as 38° C. or higher.

SUMMARY OF THE INVENTION

According to a first aspect in accordance with the present invention a process comprises (a) extruding melted 3GT through a spinneret;

(b) quenching the extruded 3GT to form a threadline of solid filaments wherein the filaments have a tension at 130° C. greater than about 0.02 g/d;

(c) passing the filaments to a heated godet operated at a speed and temperature to heat the threadline wherein the speed and temperature to which the threadline is heated are sufficient to provide a yarn with a DWS value of about 4% or less; and (d) cooling the yarn to a temperature of about 35° C. or less.

A finish can be applied to the solid filaments after quenching. Preferably, the speed of the cool godet provides a draw ratio between the heated godet and the cool godet of about 1.04 or less. When the threadline from the cool godet is wound on a package, preferably, the winding is such that the true yarn speed is less than the speed of the cool godet. Also, preferably, the filaments are wound on a package at a tension greater than about 0.04 grams per denier (g/d).

According to another aspect in accordance with the present invention, the threadline tension is increased before passing to the cool godet.

According to a further aspect in accordance with the present invention, a melt spun poly(trimethylene terephthalate) yarn has a Dry Warm Shrinkage (DWS) of about 4% or less. Preferably, the DWS is about 2% or less. According to yet a further aspect of the invention, the melt spun poly (trimethylene terephthalate) yarn, wound on a package, upon exposure to temperatures of 41° C. for at least about 3.2 hours has a dish ratio of about 0.82 or less, or has a package diameter difference of about 2 mm or less.

According to a further aspect in accordance with the present invention, the yarn, having a DWS of about 4% or less, can be wound into a package that has a thickness of yarn layer of at least about 50 mm and a package weight of at least about 6 kg. The wound package could have a thickness of yarn layer of at least about 63 mm, about 74 mm, about 84 mm or even at least about 94 mm and a package weight of at least about 8 kg, about 10 kg, about 12 kg or even about 14 kg. Preferably, the wound package has a bulge ratio of less than about 9%, and a dish ratio about 2% or less. Preferably, the yarn is wound about a tube, which is substantially free of crush.

Preferably, the yarn has a tenacity equal to or greater than about 2.5 g/d. Also preferably, the yarn has a modulus of less than or equal to about 23 g/d. In addition, the yarn preferably has an Uster of less than or equal to about 2%. Further, the yarn preferably has a boil off shrinkage of less than or equal to about 14%.

According to a further aspect of the present invention, a package made from melt spun poly(trimethylene terephthalate) yarn, having a DWS of about 4% or less, a thickness of yarn layers of at least about 16 mm, weighing at least about 1.5 kg and having a package diameter of at least about 142 mm, upon exposure to temperatures of at least 41° C. for at least 3.2 hours, has a dish ratio of about 0.82% or less.

According to a yet further aspect of the present invention, a package made from melt spun poly(trimethylene terephthalate) yarn, having a DWS of about 4% or less, a thickness of yarn layers of about 20–30 mm, weighing about 2–3 kg and having a package diameter of about 151–169 mm, upon exposure to temperatures of at least 41° C. for at least 3.2 hours, has a difference between package end and mid diameters of about 2 mm or less.

In another aspect of the present invention, a method comprises:

(a) measuring the unstretched length of a yarn as $L_1$;

(b) heating the yarn for a time and under a temperature sufficient for the yarn to attain at least 85% of its equilibrium shrinkage, (c) cooling the heated yarn;

(d) measuring the unstretched length of the cooled yarn as $L_2$; and (e) calculating the dry warm shrinkage (DWS) of the yarn using $$DWS = \frac{L_1 - L_2}{L_1} \times 100$$

Preferably, the heating temperature is about 30 to 90° C. Also preferably, the heating time is determined by the heating temperature according to the following relationship:

$$\text{Heating_Time} \geqq 1.561 \times 10^{10} \times e^{-0.4482[Heating_Temperature]}$$

where the heating time is in minutes and the heating temperature is in degrees Celsius. More preferably, the heating time is determined by the heating temperature according to the following relationship:

$$\text{Heating_Time} \geqq 1.993 \times 10^{12} \times e^{-0.5330[Heating_Temperature]}$$

where the heating time is in minutes and the heating temperature is in degrees Celsius.

DETAILED DESCRIPTION

Figure 1:
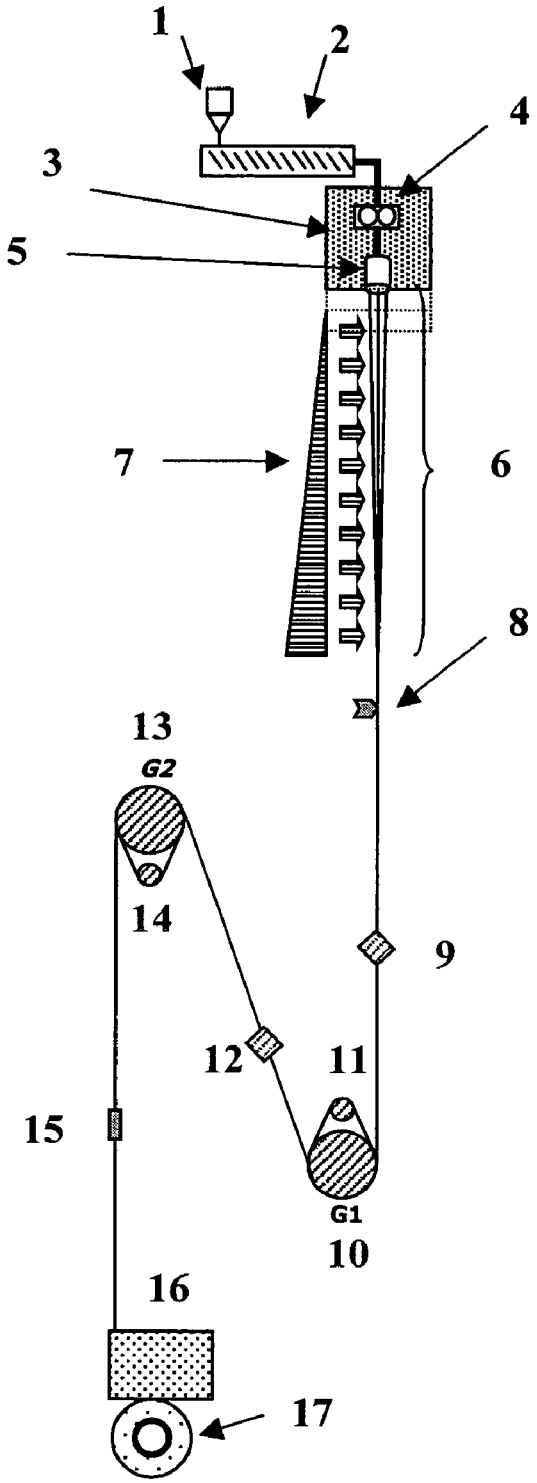
FIG. 1 illustrates a spinning configuration useful in this invention.

The present invention provides 3GT feeder yarns for drawing and texturing processes with improved aging resistance due to annealing during spinning, as well as, 3GT direct end use yarns. In particular, the present invention provides yarns that are stable upon storage where temperatures may reach 38° C., and even higher. The stable yarn allows easy package winding during spinning, enabling production of large size packages, that is, over 6 kilograms in size, with low dish ratio and low bulge ratio after storage. In addition, the packages are not susceptible to tube crushing. The 3GT yarns produced by the process of this invention have similar elongation and tenacity as other yarns produced without annealing, thereby maintaining productivity in the spinning process. The present invention provides a spinning process wherein the spinning parameters for the spinning process are selected based on resistance to aging as determined by an aging test.

Poly(trimethylene terephthalate) 3GT

The yarns provided in the present invention are based on 3GT polymer, which encompasses homopolymer and copolyesters or copolymers containing at least about 70 mole % tri(methylene terephthalate) repeating units. Preferred poly(trimethylene terephthalate)s contain at least about 85 mole %, more preferably at least about 90 mole %, even more preferably at least about 95 or at least about 98 mole %, and most preferably about 100 mole %, trimethylene terephthalate repeating units.

By "copolyesters or copolymers" reference is made to those polyesters made using 3 or more reactants, each having two ester forming groups. For example, a copoly (trimethylene terephthalate) can be used in which the comonomer used to make the copolyester is selected from the group consisting of linear, cyclic, and branched aliphatic dicarboxylic acids having 4–12 carbon atoms (for example, butanedioic acid, pentanedioic acid, hexanedioic acid, dodecanedioic acid, and 1,4-cyclohexanedicarboxylic acid); aromatic dicarboxylic acids other than terephthalic acid and having 8–12 carbon atoms (for example, isophthalic acid and 2,6-naphthalenedicarboxylic acid); linear, cyclic, and branched aliphatic diols having 2–8 carbon atoms (other than 1,3-propanediol, for example, ethanediol, 1,2-propanediol, 1,4-butanediol, 3-methyl-1,5-pentanediol, 2,2-dimethyl-1,3-propanediol, 2-methyl-1,3-propanediol, and 1,4-cyclohexanediol); and aliphatic and aromatic ether glycols having 4–10 carbon atoms (for example, hydroquinone bis(2-hydroxyethyl)ether, or a poly(ethylene ether)glycol having a molecular weight below about 460, including diethyleneether glycol). The comonomer typically can be present in the copolyester at a level in the range of about 0.5 to about 15 mole %, and can be present in amounts up to about 30 mole %.

The poly(trimethylene terephthalate) can contain minor amounts of other comonomers, and such comonomers are usually selected so that they do not have a significant adverse effect on properties. Such other comonomers include 5-sodium-sulfoisophthalate, for example, at a level in the range of about 0.2 to 5 mole %. Very small amounts of trifunctional comonomers, for example trimellitic acid, can be incorporated for viscosity control.

The intrinsic viscosity (I.V.) of the poly(trimethylene terephthalate) of the invention is at least about 0.80 dl/g, preferably at least about 0.90 dl/g, and most preferably at least about 1.0 dl/g. The intrinsic viscosity of the polyester compositions of the invention are preferably up to about 2.0 dl/g, more preferably up to about 1.5 dl/g, and most preferably up to about 1.2 dl/g. It should be recognized that to achieve a stable threadline and to produce a stable yarn, poly(trimethylene terephthalate) having a lower intrinsic viscosity needs a higher spinning speed than polymer having a higher intrinsic viscosity.

Poly(trimethylene terephthalate) and preferred manufacturing techniques for making poly(trimethylene terephthalate) are described in U.S. Pat. Nos. 5,015,789, 5,276,201, 5,284,979, 5,334,778, 5,364,984, 5,364,987, 5,391,263, 5,434,239, 5,510,454, 5,504,122, 5,532,333, 5,532,404, 5,540,868, 5,633,018, 5,633,362, 5,677,415, 5,686,276, 5,710,315, 5,714,262, 5,730,913, 5,763,104, 5,774,074, 5,786,443, 5,811,496, 5,821,092, 5,830,982, 5,840,957, 5,856,423, 5,962,745, 5,990,265, 6,232,511, 6,235,948, 6,245,844, 6,255,442, 6,277,289, 6,281,325, 6,297,408, 6,312,805, 6,325,945, 6,331,264, 6,335,421, 6,350,895, 6,353,062, and 6,437,193, H. L. Traub, "Synthese und textilchemische Eigenschaften des Poly-Trimethylene-terephthalats", Dissertation Universitat Stuttgart (1994), S. Schauhoff, "New Developments in the Production of Poly (trimethylene terephthalate) (PTT)", Man-Made Fiber Year Book (September 1996), and U.S. patent application Ser. No. 10/057,497, all of which are incorporated herein by reference. Poly(trimethylene terephthalate)s useful as the polyester of this invention are commercially available from E. I. du Pont de Nemours and Company, Wilmington, Del., under the trademark Sorona.

The poly(trimethylene terephthalate) can also be an acid-dyeable polyester composition as described in U.S. patent application Ser. No. 09/708,209, filed Nov. 8, 2000 (corresponding to WO 01/34693) or Ser. No. 09/938,760, filed Aug. 24, 2002, both of which are incorporated herein by reference. The poly(trimethylene terephthalate)s of U.S. patent application Ser. No. 09/708,209 comprise a secondary amine or secondary amine salt in an amount effective to promote acid-dyeability of the acid dyeable and acid dyed polyester compositions. Preferably, the secondary amine unit is present in the polymer composition in an amount of at least about 0.5 mole %, more preferably at least about 1 mole %. The secondary amine unit is present in the polymer composition in an amount preferably of about 15 mole % or less, more preferably about 10 mole % or less, and most preferably about 5 mole % or less, based on the weight of the composition. The acid-dyeable poly(trimethylene terephthalate) compositions of U.S. patent application Ser. No. 09/938,760, filed Aug. 24, 2001, comprise poly(trimethylene terephthalate) and a polymeric additive based on a tertiary amine. The polymeric additive is prepared from (i) triamine containing secondary amine or secondary amine salt unit(s) and (ii) one or more other monomer and/or polymer units. One preferred polymeric additive comprises polyamide selected from the group consisting of poly-imino-bisalkylene-terephthalamide, -isophthalamide and -1,6-naphthalamide, and salts thereof. Acid-dyeable fibers can also be prepared using tetramethylpiperidine polyether glycols as described in U.S. Pat. No. 4,001,190, which is incorporated herein by reference. The poly(trimethylene terephthalate) useful in this invention can also comprise cationically dyeable or dyed compositions such as those described in U.S. Pat. No. 6,312,805, which is incorporated herein by reference, and dyed or dye-containing compositions.

Other polymeric additives can be added to the poly (trimethylene terephthalate) to improve strength, to facilitate post extrusion processing or provide other benefits. For example, hexamethylene diamine can be added in minor amounts of about 0.5 to about 5 mole % to add strength and processability to the acid dyeable polyester compositions of the invention. Polyamides such as Nylon 6 or Nylon 6—6 can be added in minor amounts of about 0.5 to about 5 mole % to add strength and processability to the acid-dyeable polyester compositions of the invention. A nucleating agent, preferably about 0.005 to about 2 weight % of a monosodium salt of a dicarboxylic acid selected from the group consisting of monosodium terephthalate, mono sodium naphthalene dicarboxylate and mono sodium isophthalate, as a nucleating agent, can be added as described in U.S. Pat. No. 6,245,844, which is incorporated herein by reference.

The poly(trimethylene terephthalate) can, if desired, contain additives, e.g., delusterants, nucleating agents, heat stabilizers, viscosity boosters, optical brighteners, pigments, and antioxidants. $TiO_2$ or other pigments can be added to the poly(trimethylene terephthalate), the blend, or in fiber manufacture. (See, e.g., U.S. Pat. Nos. 3,671,379, 5,798,433 and 5,340,909, 6,153,679, EP 699 700, and WO 00/26301, which are incorporated herein by reference.)

Spinning Process

In the process of the present invention, spinning can be carried out using conventional equipment known in the art with respect to producing polyester fibers. Typically, 3GT is available as a flaked material. The flakes are dried in a typical flake drying system for polyester. Typically the moisture content after drying will be about 40 ppm (parts per million) or less.

The steps of extruding, quenching and applying a finish to the filaments can be performed by any methods standard in the art of spinning polyester yarns. Typically, once the polymer streams are extruded from the spinnerets they are quenched to form solid filaments. Quenching can be carried out in a conventional manner, using air or other fluids described in the art (e.g., nitrogen). Cross-flow, radial or other conventional techniques may be used. Preferably the streams are quenched with air. A conventional spinning finish is applied to the filaments.

Once a finish is applied to the filaments, the filaments are optionally passed through an interlace jet, and then to a heated godet.

Temperature and the number of turns on the heated godet should be sufficient to anneal the filaments and offer a stable threadline. Generally this temperature will be in the range of about 90–165° C., preferably about 115–160° C., more preferably about 125–155° C. The filaments typically make about 4–10 turns on the heated godet whereby the filaments are heated and annealed. Fewer turns will be necessary at higher temperatures of the heated godet, while more turns allow for lower temperatures for sufficient annealing to occur. Too many or too few turns may result in making the filaments unstable. For example, with too few turns, the godet may have difficulty holding the threadline properly, which can result in spillage between the godet and the threadline. With too many turns, the godet may shake and destabilize the threadline. The filaments are sufficiently annealed when the DWS value of the yarn product is about 4% or less.

The minimum spin speed in the present invention for a given 3GT polymer having a particular I.V., should ensure that the filaments, after solidifying, and before reaching the heated godet, are sufficiently crystalline, that is, the filaments have a tension at 130° C. of at least about 0.02 g/d, preferably at least about 0.03 g/d. Crystallinity permits the spin line to have a tension to stabilize the threadline and to support orientation relaxation. The crystalline yarn is heated, or annealed, on a godet for a number of turns, at a temperature and speed, wherein the speed is at least the minimum spin speed to provide a stable process.

The speed of the heated godet is defined as the spin speed. Higher polymer I.V. will allow slower spin speeds and, a lower polymer I.V. may need higher spin speeds for a stable spin-annealing process with sufficient spinline tension. For example, if a homo-polymer with polymer I.V. of about 1.02 is applied, the speed of the heated godet is at least about 3000 m/m to meet the requirement of tension at 130° C. For homo-polymer with polymer I.V. less than about 1.02, the speed of the heated godet is at least at a value that is higher than about 3000 m/m. For homo-polymer whose I.V. is higher than about 1.02, the speed of the hot godet is at least at a value that is lower than about 3000 m/m. For copolymers or blended polymers, the speed of the hot godet is similarly adjusted to give the solidified filament before reaching the hot godet to have a tension at 130° C. greater than about 0.02 g/d.

After the heated godet, the threadlines pass to a cool godet, which is at a temperature to cool the threadlines to about 35° C. or less. The temperature of the cool godet is typically ≦about 35° C. It is important that the threadline is cooled on a cool godet after annealing by the heated godet to adjust threadline tension. Additional heating devices, such as another heated godet, or a heater can be used prior to cooling the threadline. The cooled filaments make at least 0.5 turns on a cool godet. More turns of the threadline on the cool godet may be required when there is no cooling device before or after the cool godet.

Preferably, the threadlines are cooled by an appropriate means between the heated and cool godet. Typically, cooling is accomplished by passing the threadlines from the heated godet to an interlace jet. Use of an interlace jet provides, in addition to cooling, increased tension in the threadline for passing to the cool godet.

The speed of the cool godet is such that a draw ratio (draw ratio=speed of cool godet/speed of heated godet, in a two godet system) is less than about 1.04. Preferably the draw ratio is less than about 1.02, more preferably the draw ratio is about 1.0 or less. When the cool godet is slower than the heated godet, that is, draw ratio is less than about 1, the threadlines relax.

Draw ratio is limited on the lower end to that which allows spinning to run. If draw ratio is too low, there will not be sufficient threadline tension to maintain the threadline passing the godets at the desired spin speeds. As draw ratio increases, the elongation significantly decreases and tenacity increases, which results in lower productivity for spinning. Draw ratio above about 1.04 may cause package winding problems such as dish formation and tube crushing, which render the yarn package unusable.

The filaments are then wound onto a package wherein the true yarn speed, which is herein defined as the yarn speed at windup, is less than the speed of the cool godet. True yarn speed is provided by the following equation:

$$\text{True yarn speed} = \frac{SP(WU)}{\cos(HA)} \tag{II}$$

wherein SP(WU) is the windup speed; HA is the winding helix angle. The filaments are wound at a winding tension greater than about 0.04 g/d, preferably greater than about 0.05 g/d. The filaments are wound at a winding tension less than about 0.12 g/d, preferably less than about 0.10 g/d, and more preferably less than about 0.8 g/d. The winding tension is controlled by a windup overfeed, according to equation (III).

$$OvFd\ (WU) = 100\% \times \frac{SP(G2) - TYS}{SP(G2)} \tag{III}$$

wherein OvFd (WU) is the windup overfeed; SP(G2) is the spinning speed of the cool godet, and TYS is the true yarn speed as defined above.

While the above discussion refers to a heated godet as a first godet and a cool godet as a second godet, it should be recognized that alternative spinning configurations may be used so long as they do not depart from the spirit of the invention. For example, the quenched threadline may be first spun on a cool godet prior to spinning on a "first" heated godet as described above. The prior cool godet may run at the same speed as the heated godet or slightly higher. Alternatively two heated godets may be used prior to a cool godet. Other alternatives may include replacing the heated godet or the cool godet (or both) by a set of godets, two or more godets in a set, so long as the threadline is first passed to a heated godet or heated godet set and then to a cool godet or cool godet set.

In alternative spinning configurations, definition of draw ratio changes. For example, if three godets are used in sequence cool-heated-cool, or in sequence heated-cool-cool, the draw ratio is defined as the speed ratio between the cool godet, which is located immediately after the heated godet, and the heated godet. If a second heated godet is used, such as in a godet sequence, heated-heated-cool, the draw ratio is defined as the speed ratio between the cool godet, and the first heated godet.

The process of this invention may be practiced with reference to FIG. 1. However, this is meant to be only illustrative, and should not be construed as limiting the scope of the invention. Variations will be readily appreciated by those skilled in the art. Poly(trimethylene terephthalate) polymer is supplied to hopper 1, which feeds the polymer to extruder 2 into spinning block 3. Spinning block 3 contains spinning pump 4 and spinning pack 5. Polymer threadline 6 exits the spinning block 3 and is quenched 7 with air. A finish is applied to threadline 6 at finish applicator 8. Threadline 6 is cooled via interlace jet 9, and passes to the first heated godet 10, with its separator roll 11. Threadline 6 is cooled via interlace jet 12 and passes to second cool godet 13 with separator roll 14. Threadline 6 passes through fanning guide 15 to winder 16 onto package 17.

Yarn Package Aging

Aging in yarn packages, such as 3GT POY packages, is manifested by phenomena such as "bulge formation," "dish formation," and "tube crushing," in addition to changes in the properties of the yarn throughout the yarn package.

1. Bulge Formation

Figure 2:
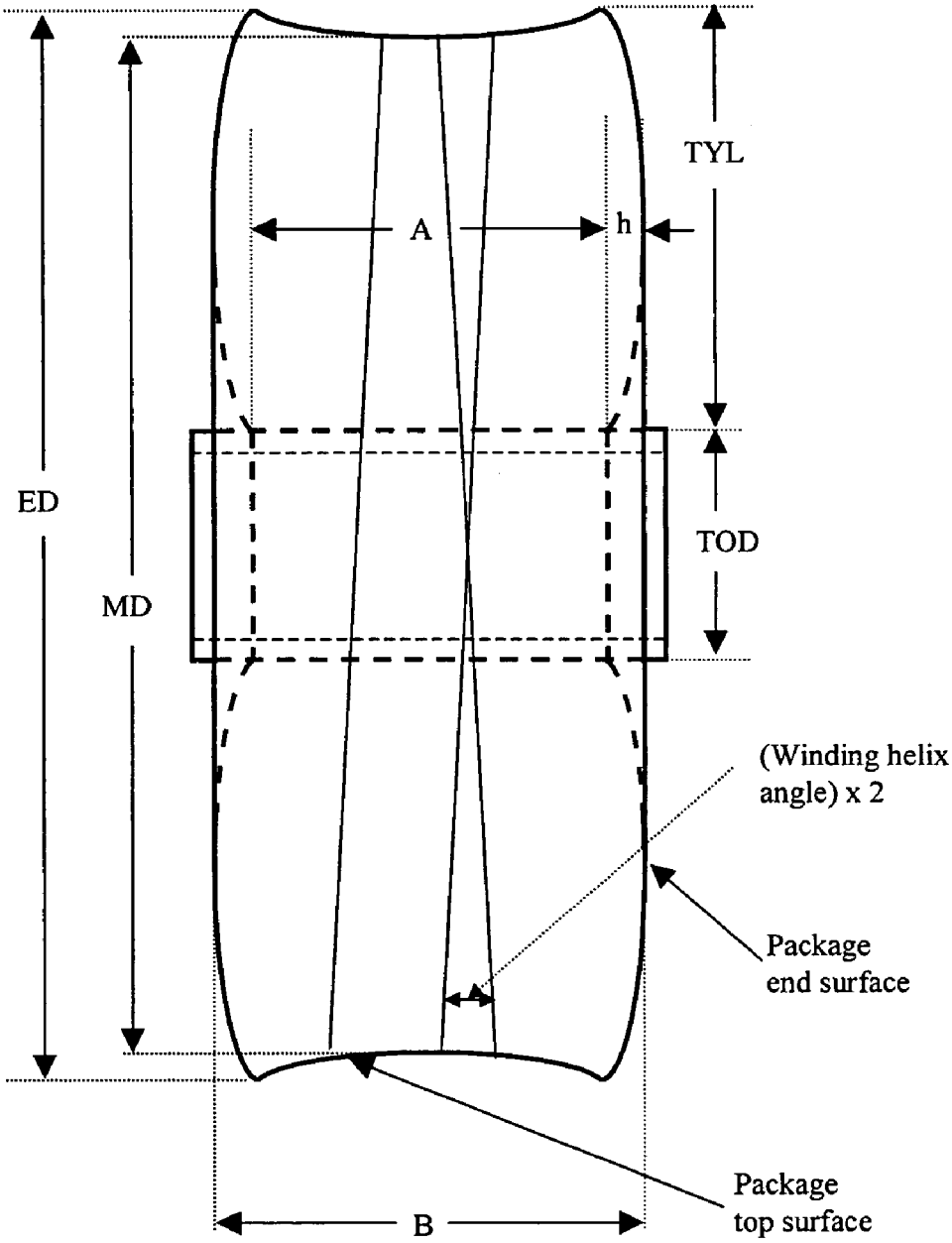
FIG. 2 provides a schematic illustration of a yarn package demonstrating bulge and dish deformation.

Bulge is the deformation in the direction along the package length wherein the yarn expands in a vertical direction above the original end surface of the package, see FIG. 2. Bulge formation may be described quantitatively by a bulge ratio per equation (V), as illustrated in FIG. 2:

$$\text{Bulge Ratio} = \frac{h}{TYL} \times 100\% \text{ or } \frac{B-A}{ED-TOD} \times 100\% \quad \text{(V)}$$

wherein h is the bulge height; TYL is the thickness of the yarn on the package; B is the maximum length of the yarn package; A is the length of the package along the surface of the tube core; ED is the diameter at the end of the package, "package end diameter"; TOD is the tube outside diameter. Bulge height, h, has the relationship in equation III and the thickness of the yarn layer of a package, TYL has the relationship in equation (IV).

$$A+2h=B \quad \text{(III)}$$

$$TOD+2TYL=ED \quad \text{(IV)}$$

It should be noted that the calculation for bulge ratio includes the impact of the package diameter through the thickness of yarn layer, "TYL." Therefore, a small diameter package could make a significant bulge appear to be small. Bulge formation may develop during package winding, package doffing or during yarn storage.

2. Dish Formation

Dish formation refers to the package deformation in the direction along the package radius wherein the yarn between the two package end surfaces contracts more than these near end surfaces so that package mid diameter is smaller than the end diameter, see FIG. 2. Dish deformation may be quantitatively described as a dish ratio per equation (VI).

$$\text{Dish Ratio} = \frac{ED-MD}{A} \times 100\% \quad \text{(VI)}$$

where ED is the diameter at the end of the package, "package end diameter"; MD is the diameter of the package in the middle of the package, "package mid diameter"; and A is the length of the package along the surface of the tube core. Dish formation may develop during package winding or package storage.

3. Tube Crushing

Tube crushing refers to a phenomena in yarn packages wherein the tube, which carries the yarn, is literally crushed by the yarn carried by the tube. Tube crushing in 3GT spinning may occur during package winding. Tube crushing is a severe package formation defect and is usually accompanied by dish and/or bulge formation.

4. Yarn Property Changes

In the absence of aging, the denier of the yarn throughout a 3GT yarn package is constant. When a 3GT yarn package ages, as manifested through bulge formation or dish formation, the properties of the yarn change. Denier of the yarn, measured at the top surface of a package may increase by about 10–20 relative to the denier at the top surface prior to aging. After aging, denier may also change within a layer of yarn moving from one end surface of the package to the other end surface. However, deniers of the yarns near or at the tube core, for example, about 4–10 yarn layers, may remain unchanged after aging. As the yarn layer moves away from the tube core, the denier may rapidly increase and reach a maximum after aging. The denier may then decrease relative to the maximum, with further distance from the tube core, finally reaching the top surface at a denier between that of the yarn at the tube core and the maximum denier.

Differences in yarn denier throughout a package cause problems in draw texturing. These denier differences in the feeder yarn remain in the drawn-textured yarn and may result in lack of dye uniformity, among other undesirable features in the product yarns.

Beside changes in denier, elongation and tenacity also change upon aging, with rapid reduction in tenacity and increase in elongation. The changes in tenacity and elongation are consistent with the denier change. Whenever denier changes, the tenacity and elongation change. There may also be dramatic changes in shrinkage properties upon aging of 3GT feeder yarns.

Improved Analytical Process

The process of this invention provides a 3GT yarn for use in textiles that is resistant to aging upon prolonged exposure to environments where temperatures may exceed about 38° C. Although aging is manifested in a yarn package by bulge and/or dish formation, these phenomena may take hours or days to develop. The yarn manufacturer would prefer to manufacture only packages that resist aging. Heretofore, there has been no test method available, which can be rapidly performed, to correlate spinning process conditions with a predisposition of the spun yarn to resist aging.

Surprisingly, it has been found in the present invention that measurement of yarn shrinkage under specific conditions in a new test, entitled Dry Warm Shrinkage, or "DWS", renders predictable whether a yarn package will develop dish formation, a characteristic of aging, when stored at elevated temperatures, such as greater than about 38° C.

DWS enables prediction of yarn aging quickly, using only a short length of yarn for the measurement. Yarn packages with acceptable DWS can be safely stored for future use without risk of package deformation. DWS is not limited by package size, meaning once spinning conditions are identified, any package size can be made, using the conditions.

For purposes of this discussion, aging effects are demonstrated by dish formation. The aging resistance of a yarn is described by the difference in dish ratio of a package measured before and after storage. The greater the dish ratio after storage, the lower the aging resistance of the yarn. For a given package, if the dish ratio after storage is the same as the dish ratio before storage, the package has excellent aging resistance. If the difference is large, aging resistance is poor.

The present invention provides a method, which is an improved accelerated aging test of general applicability. The method of this invention determines aging resistance of a 3GT spun yarn by exposing a length of yarn to conditions wherein the yarn reaches at least 85%, preferably 95%, of its equilibrium shrinkage and measuring the shrinkage of the yarn. The heating temperature may be from about 30 to about 90° C., preferably, about 38 to about 52° C, and more preferably about 42 to about 48° C. The heating time at a given heating temperature in the DWS measurement is therefore:

$$\text{Heating_Time} \geqq 1.561\times10^{10}\times e^{-0.4482[Heating_Temperature]}$$

The preferred heating time is:

$$\text{Heating_Time} \geqq 1.993\times10^{12}\times e^{-0.5330[Heating_Temperature]}$$

where the heating time is in minutes and the heating temperature is in degrees Celsius. For example, at a heating temperature of 41° C., the sample heating time is to be greater than or equal to 163 minutes (2.72 hours), preferably 644 minutes (10.73 hours). If at a sample heating temperature of 45° C., the sample heating time is to be greater than or equal to 27.2 minutes (0.45 hours), preferably 76.4 minutes (1.27 hours). For purposes of the present invention, measurements should be taken after exposing the yarn to 41° C. for at least 24 hours to determine equilibrium shrinkage.

The yarn used for DWS measurement may be skein or non-loop yarn. A skein may be single loop or multiple loop, wherein the loop may be single or multiple filament. A non-loop yarn sample may contain multiple yarns or a single yarn, wherein the yarn may be single or multiple filaments.

The sample length (L1 before heating and L2 after heating) is defined as the skein length that is half of the yarn length that makes a single loop in the skein. The sample length may be any length that is practically measurable, before and after heating. The sample length L1 is typically in the range of about 10 to 1000 mm, preferably, about 50 to 700 mm. A length, L1, of about 100 mm may be conveniently used for the sample in the form of a single loop skein, and L1 of about 500 mm for the sample in the form of a multi-loop skein.

In this method, a tensioning weight is suspended from the sample of yarn to keep straight the sample to measure the length, L1. The yarn is typically made into a loop by knotting the ends. The length, L1, is measured at ambient temperature with the tensioning weight hanging on the loop. The tensioning weight should be at least sufficient to keep the sample straight, but should not cause the sample to stretch. A preferred tensioning weight for a sample yarn may be calculated according to the following:

$$\text{Tensioning Weight} = 0.1\times2\times(\text{No. loops in a skein})\times(\text{yarn denier})$$

Typically, the sample is coiled into a double loop and is hung on a rack. If hung on a rack, optionally, an applied weight may be suspended from the loop. The weight may be useful to steady the sample. The applied weight should neither limit contraction of the sample, nor cause stretch during heating. When no weight is applied, the sample may simply be placed on a surface where it is allowed to contract freely during heating.

Heating may be accomplished using a gaseous or liquid fluid. If a liquid is used, the yarn is placed in a vessel. An oven is conveniently used if the fluid is a gas, with the preferred gas being air. The sample should be placed in the heating fluid in a manner, which allows the sample to freely contract.

The sample is removed from heating and is cooled for at least about 15 minutes. The length of the heated sample is measured with the tensioning weight hung from the sample and recording this value as L2. DWS is calculated from L1 and L2 based on equation (VII):

$$DWS\ (\%) = \frac{L_1 - L_2}{L_1}\times100 \qquad \text{(VII)}$$

Surprisingly, DWS corresponds to aging resistance of the yarn, as manifested, for example, by dish formation.

Figure 3:
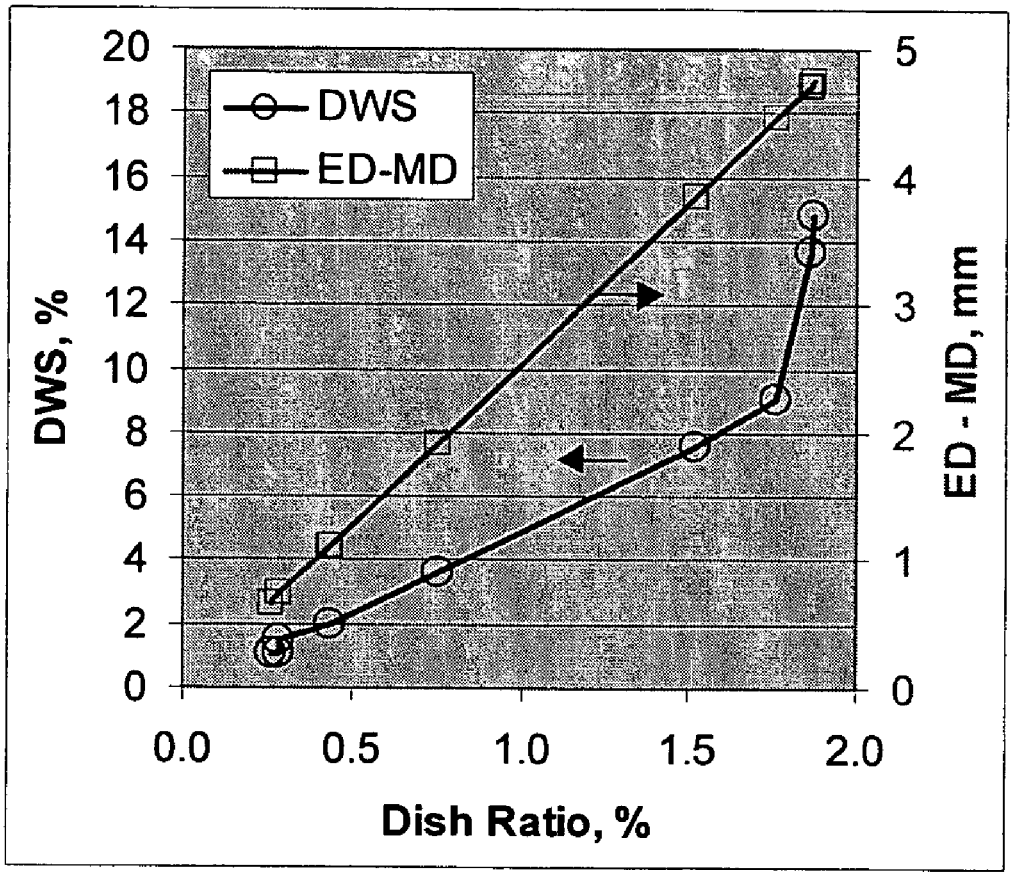
FIG. 3 is a graph showing the relationship between DWS, and package diameter differences on aging with dish ratio, an aging phenomenon.
Figure 4:
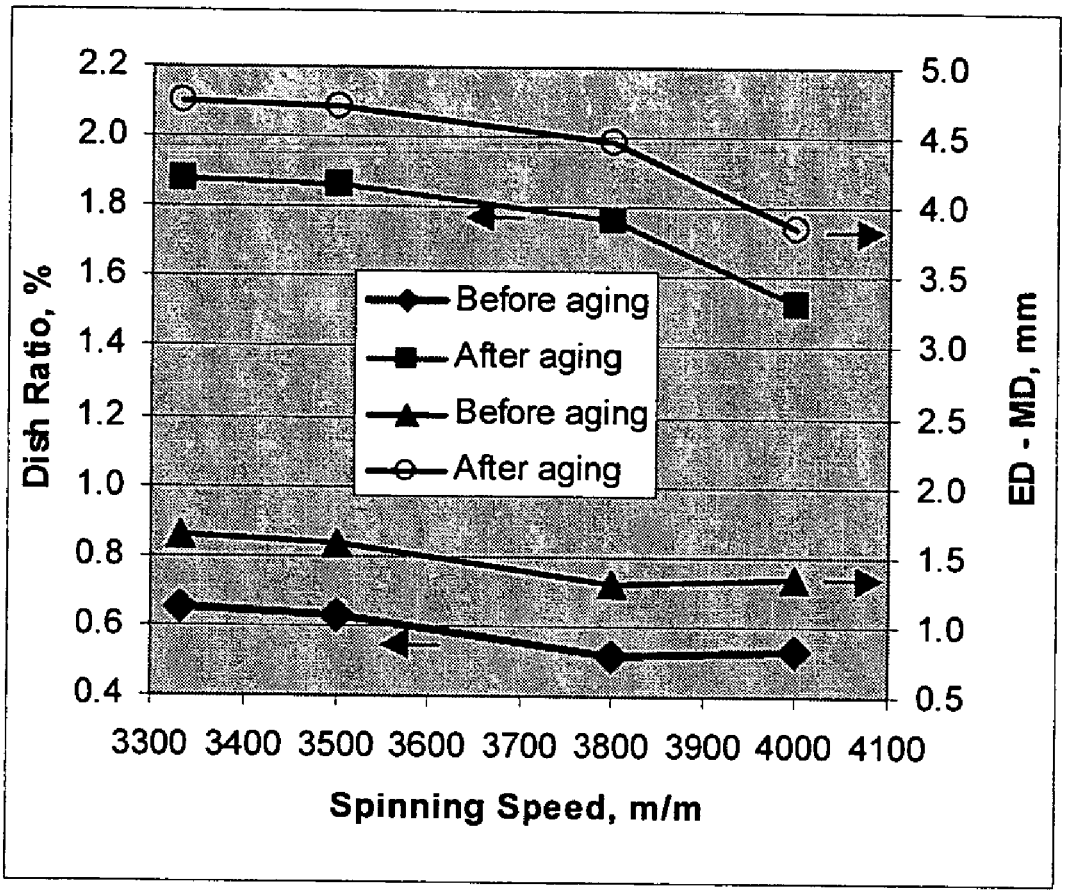
FIG. 4 is a graph showing dish ratio and package diameter difference for a yarn package before and after aging.

FIG. 3 is a graph showing the correlation of DWS with dish ratio. As previously stated, development of dish ratio is a manifestation of package aging. DWS along with ED−MD, which is the diameter difference, (package end diameter−package mid diameter) are plotted against dish ratio for packages after exposing individual yarn packages of about 2.5 kg, 160 mm in diameter, to a temperature of 41° C. for 3.2 hours. DWS values of the packages were measured before the exposure. Dish ratio and the diameter difference were measured after the exposure. As can be seen from FIG. 3, DWS increases as dish ratio increases and thus correlates with dish formation.

While not wishing to be bound by theory, it is believed that package deformation caused by aging results from yarn shrinkage, while DWS measures the yarn shrinkage that can develop upon yarn storage at temperatures similar to those encountered in warm climates during the summer months in the absence of air-conditioning. Therefore, DWS can be used to effectively describe the aging resistance of a yarn.

Commercial standards for filament spinning allow a diameter difference of ED−MD in a yarn package, 2.5 kg, 160 mm in diameter, of 2 mm. Therefore, if an aged yarn has a diameter difference of about 2 mm or less, the yarn has acceptable aging resistance per commercial standards.

Diameter difference is related to DWS as shown in the graph of FIG. 3. According to FIG. 3, where ED−MD=2 mm, dish ratio=0.8% and DWS=4%. Therefore, a yarn having a DWS value of about 4% or less has acceptable aging resistance. Conditions for an acceptable spinning process where a yarn is annealed during spinning, can therefore be determined, if the product yarn has a DWS value of less than or equal to about 4%, preferably less than or equal to about 2%; the dish ratio is less than or equal to about 0.8%, preferably less than or equal to about 0.44%; the diameter difference is less than or equal to about 2 mm, preferably less than or equal to about 1.1 mm.

It is important to recognize that ED−MD and dish ratio provided above are limited by package size. The package size in these studies was 160 mm in diameter and 2.5 kg in weight. Increases in package size will require an increase in the limits for ED–MD and dish ratio. However, DWS is not affected by package size, therefore DWS applies to any yarn package of any size. Once DWS is measured for a yarn, it can be immediately assessed whether the yarn will be resistant to aging during storage.

Yarn and Package Properties

Yarn produced in accordance with the present invention may be described as possessing one or more of the following properties.

(1) The yarn is resistant to aging as indicated by having a dry warm shrinkage (DWS) value of less than or equal to about 4%, preferably less than or equal to about 2%, based on the DWS aging test as already described above.

Alternatively, but limited by package size, the aging resistance of the yarn may be described by dish ratio and bulge ratio developed in an aging test described by the aging Conditions (A) and (B) for a sample package that meets Condition (C). The yarn is resistant to aging if the following two conditions are met:

Dish ratio≦about 0.82%, and

Difference in bulge ratio before and after the aging test ≦about 5%

(A) Temperature 41° C.

(B) Heating time 3.2 hours (C) The thickness of yarn layers measured between the outer surface of the tube core and the outer surface of the package is about 25 mm.

(2) The yarn has an elongation of less than or equal to about 105%. The elongation is similar to that provided by a spinning process under similar conditions, but without annealing and no drawing, referred to herein as a "simple" spinning process. Generally higher elongation is preferred, with a draw ratio of less than or equal to about 1, to avoid decreases in spin productivity in a subsequent draw-texturing process. However, an elongation of greater than about 105% is not desirable to maintain spinning process stability.

When the product yarn is intended for direct end use, elongation may be specified, and spinning conditions adjusted to provide for the specified elongation.

(3) The yarn of this invention has a tenacity of greater than or equal about 2.5 g/d, preferably greater than about 2.8 g/d, which is similar to the tenacity achieved in a simple spinning process.

(4) The yarn has a modulus of less than or equal to about 23 g/d, preferably less than 22.5 g/d. The modulus is advantageously slightly lower in the yarn of this invention than provided in a simple spinning process.

(5) Uster, U %, of the yarn, is less than or equal to about 2%, preferably less than about 1.5%, which is similar to Uster provided in a simple spinning process. One important impact of aging to the DTY feed yarn is the increased non-uniformity of yarn after aging. The increased non-uniformity of yarn results in a significantly increased U %, which is related to dye defects of DTY yarns.

(6) The boil off shrinkage (BOS) of the yarn of this invention is less than or equal to about 14%, preferably less than about 10%. This yarn has significantly reduced BOS relative to yarns produced in a simple spinning process. A low BOS value is important for direct end use yarns. If the BOS of SAY is higher than about 14%, the fabric shrinkage may be too high to be acceptable.

(7) Tension at 130° C. (Tens130). is equal to or greater than about 0.02 grams/denier (g/d).

(8) Shrinkage onset temperature (Ton) of about 45–70° C., preferably about 50–70° C. From aging resistance point of view, a high shrinkage onset temperature tends to have less chance for the yarn to age during yarn storage.

(9) First thermal tension peak temperature (T(p1)) of about 60°–90° C., preferably about 65–90° C. For the simple spinning at spinning speeds applied for SAY spinning in accordance with the present invention, two peak thermal tensions are typically observed in the thermal tension temperature measurement. The first peak thermal tension is near room temperature. The second peak thermal tension is related to the disorientation in crystalline region. Since the second peak tension is frequently affected by sample preparation or difficult to determine, the inventors use the tension value at 210° C. to represent the second tension peak. Because the first peak tension temperature is so close to the shrinkage onset temperature for the yarns having two tension peaks, the factors affecting the shrinkage onset temperature affects the first tension peak temperature in a similar way.

(10) First peak tension of about 0.03–0.15 g/d, preferably about 0.03–0.10 g/d. A lower first peak tension gives a low driving force for a yarn to shrink at an elevated yarn storage temperature. To improve the aging property of a yarn, it is desired for the resultant yarn to have a low first peak tension. A low first peak tension goes together with a low spinning tension. Therefore, the first peak tension should not be lower than about 0.03 g/d. On the other hand, an excessively high first peak tension usually means a significant drawing is applied in the spinning. In such a case, when the first peak tension is higher than about 0.15 g/d, it is a strong evidence for the occurrence of package winding with crushed tube in SAY spinning.

Yarn packages have been prepared using the spinning process of this invention to provide yarns resistant to aging. Yarn packages are not limited to small size, and larger packages are contemplated.

In accordance with an aspect of the present invention, a wound package of melt spun poly(trimethylene terephthalate) of this invention has a thickness of yarn layer of at least about 50 mm and a package weight of at least about 6 kg. Preferably, the wound package has a thickness of yarn layer of at least about 63 mm and a package weight of at least about 8 kg. More preferably, the package has a thickness of yarn layer of at least about 74 mm and a package weight of at least about 10 kg. Even more preferably, the package has a thickness of yarn layer of at least about 84 mm and a package weight of at least about 12 kg. Most preferably, the package has a thickness of yarn layer of at least about 94 mm and a package weight of at least about 14 kg. As used herein, "package weight" is intended to include the weight of yarn only and to exclude the weight of the tube. Preferably, the wound package has a bulge ratio of less than about 9%, and a dish ratio about 2% or less, preferably about 1% or less. Preferably, the yarn is wound about a tube, which is substantially free of crush, or there is no tube crush winding during spinning.

EXAMPLES

Test Methods

Elongation and tenacity were measured using an Instron Corp. tensile tester, model no. 1122. Elongation to break and tenacity were measured according to ASTM method D2256.

Boil off shrinkage ("BOS") was determined according to ASTM D2259 as follows. A weight was suspended from a length of yarn to produce a 0.2 g/d (0.18 cN/dtex) load on the yarn and then measuring its length, $L_1$. The weight was then removed and the yarn was immersed in boiling water for 30 minutes. The yarn was then removed from the boiling water, centrifuged for about one minute and allowed to cool for about 5 minutes. The cooled yarn was then loaded with the same weight as before. The new length of the yarn, $L_2$, was recorded. The percent shrinkage was calculated according to equation I, below:

$$\text{Shrinkage}\ (\%) = \frac{L_1 - L_2}{L_1} \times 100 \qquad \text{I}$$

Dry Warm Shrinkage ("DWS"). A sample length of a single loop skein yarn comprising multiple filaments was selected. A tensioning weight was suspended from a length of yarn to produce a 0.2 g/d (0.18 cN/dtex) load on the yarn and then measuring its length, $L_1$, of 100 mm. A paper clip weighing about 0.51 g was attached to the loop. The yarn was placed on a rack and then into an air heated oven at about 45° C. for 2 hours. The yarn was then removed from the oven and allowed to cool for about 15 minutes and then the length was measured again as recorded as $L_2$. The percent shrinkage was then calculated according to equation I , above.

Thermal mechanical analysis for purposes herein is a measurement of thermal tension versus temperature. The following properties may be obtained from the thermal-tension-temperature measurement: shrinkage onset temperature, first peak thermal tension, first peak tension temperature, second peak thermal tension (the second peak tension temperature is fixed at 210° C. for purposes herein), and thermal tension at 130° C.

Measurement of thermal tension versus temperature was carried out at a heating rate of 30° C./minute using a shrinkage-tension-temperature measurement device produced by DuPont. The instrument uses samples in a single loop in a length described below. The whole sample is heated uniformly at a given and constant heating rate in the instrument. When the thermal tension is measured against temperature, the sample length is maintained constant and a pretension is applied onto the sample before heating begins. The thermal tension is measured during the heating. For 3GT filament, the sample is heated, from 25–30° C. to 210–215° C. The heating rate is constant. Several heating rate are available, such as 3, 5, 10, 30° C./min and so on. The yarn sample was prepared as a loop from about 200 mm of yarn, for a loop about 100 mm long. The pre-tension applied in a tension-temperature measurement was 0.005 gram/denier, i.e., the pre-tension (grams)=yarn denier×2×0.005 (gram/denier).

The shrinkage onset temperature (Ton) describes the starting point of yarn shrinkage. The shrinkage onset temperature (Ton) is obtained by drawing a straight line through the rapid increment of thermal tension, and drawing a straight line parallel to temperature axis and passing the minimum tension before the tension is rapidly increased. The temperature of the cross-point of the two straight lines is defined as the shrinkage onset temperature (Ton).

Uster, the mean deviation unevenness, U %, was measured according to ASTM Method D-1425 using Uster Tester 3, Type UT3-EC3 manufactured by Zellweger Uster. U %, Normal value was obtained at strand speed of 200 m/m, with a test time of 2.5 minutes.

Examples 1–2

Poly(trimethylene terephthalate), (3GT), flakes, provided by E. I. DuPont de Nemours and Company, Inc., Wilmington, Del., having an I.V. of 1.02 and a moisture content of less than 40 ppm were fed into an extruder for remelting, then transferred to a spinning block and extruded from spinnerets at a temperature of 264° C. The spinneret had 34 holes, with a diameter of 0.254 mm. The molten polymer stream from the spinnerets first entered an unheated quench delay zone 70 mm in length from spinneret to the beginning of quench, followed by a cross flow quench air zone to become solid filaments. After being applied with a metering finish application, the filaments passed a first interlace jet and entered a drawing system where the filaments were passed to two godets with diameters of 190 mm. Spinning parameters are provided in Table 1. The filaments were passed to a heated godet, then to a cool godet after first passing through an interlace jet to reduce temperature, as in FIG. 1. The filaments were passed from the cool godet through a fanning guide to wind-up. The winding tension was controlled at 0.06 g/d by a windup overfeed of 0.70%. The tube core applied in this work had the following specifications:

| | |
|---|---|
| Tube core Length: | 300 mm |
| Winding stroke: | 257 mm |
| Tube core outside diameter: | 110 mm |
| Tube wall thickness: | 7 mm |

The properties of the resultant yarns are provided in Table 2.

Comparative Examples A–D

The process of Examples 1–2 was repeated except that the heated godet was held at room temperature and no annealing was performed. Spinning parameters are provided in Table 1. The properties of the resultant yarns are provided in Table 2.

Comparative Examples E and F

The process of Examples 1–2 was repeated except that the heated godet was held at temperatures, which did not sufficiently anneal the yarn to meet aging resistant criteria. Spinning parameters are provided in Table 1. The properties of the resultant yarns are provided in Table 2.

TABLE 1

Spinning Conditions for Examples 1–2 and Comparative Examples A–F

| Example | Turn(G1) (a) | T(G1) ° C. (b) | Turn(G2) (c) | DR (d) | SP(G1) m/m (e) | SP(G2) m/m (f) | SP(WU) m/m (g) | OF(WU) % (h) | Tw g (i) |
|---|---|---|---|---|---|---|---|---|---|
| 1 | 6s7g | 135 | 3s4g | 0.9989 | 3334 | 3330 | 3277 | 0.7 | 6.2 |
| 2 | 6s7g | 115 | 3s4g | 0.9989 | 3334 | 3330 | 3277 | 0.7 | 6.0 |
| A | 4s5g | rt | 0s1g | 1.0000 | 3334 | 3334 | 3281 | 0.7 | 8.4 |

TABLE 1-continued

Spinning Conditions for Examples 1–2 and Comparative Examples A–F

| Example | Turn(G1) (a) | T(G1) ° C. (b) | Turn(G2) (c) | DR (d) | SP(G1) m/m (e) | SP(G2) m/m (f) | SP(WU) m/m (g) | OF(WU) % (h) | Tw g (i) |
|---|---|---|---|---|---|---|---|---|---|
| B | 4s5g | rt | 0s1g | 1.0000 | 3500 | 3500 | 3444 | 0.7 | 9.1 |
| C | 4s5g | rt | 0s1g | 1.0000 | 3800 | 3800 | 3732 | 0.9 | 8.6 |
| D | 4s5g | rt | 0s1g | 1.0000 | 4001 | 4001 | 3921 | 1.1 | 8.6 |
| E | 6s7g | 95 | 3s4g | 0.9989 | 3334 | 3330 | 3277 | 0.7 | 5.7 |
| F | 6s7g | 75 | 3s4g | 0.9989 | 3334 | 3330 | 3277 | 0.7 | 5.6 |

(a) Turns of threadline on first godet; g = turns on godet; s = turns on separator roll.
(b) Temperature of first godet. "rt" is room temperature.
(c) Turns of threadline on second godet.
(d) Draw Ratio (ratio of speed of first godet to speed of second godet).
(e) Speed of first godet.
(f) Speed of second godet.
(g) Windup speed.
(h) Windup overfeed.
(i) Winding tension in grams (g)

TABLE 2

Yarn Properties for Examples 1–2 and Comparative Examples A–F

| Example | DWS % | BOS % | Denier | Modulus g/d | Tenacity g/d | $E_b$ % | % U | T(p1) ° C. | Tens(p1) g/d | Ton ° C. | Tens (130° C.) g/d | Dish ratio, % - before | Dish ratio, % - after |
|---|---|---|---|---|---|---|---|---|---|---|---|---|---|
| 1 | 1.5 | 5.8 | 106.4 | 20.8 | 3.02 | 79.5 | 0.83 | 77.6 | 0.042 | 57.18 | 0.0429 | 0.15 | 0.29 |
| 2 | 2.6 | 12.5 | 106.6 | 20.8 | 3.08 | 79.5 | 0.88 | 66.9 | 0.050 | 53.16 | 0.0452 | | |
| A | 14.9 | 36.9 | 106.7 | 21.1 | 3.06 | 79.7 | 0.85 | 53.8 | 0.065 | 51.29 | 0.0463 | 0.65 | 1.87 |
| B | 13.7 | 32.2 | 101.7 | 21.4 | 3.14 | 77.6 | 0.85 | 57.6 | 0.071 | 51.60 | 0.0612 | 0.63 | 1.86 |
| C | 9.1 | 23.7 | 94.1 | 21.9 | 3.16 | 72.0 | 0.81 | 61.6 | 0.080 | 52.26 | 0.0784 | 0.52 | 1.76 |
| D | 7.6 | 14.4 | 89.4 | 21.5 | 3.19 | 71.5 | 0.77 | 62.6 | 0.088 | 52.64 | 0.0770 | 0.53 | 1.52 |
| E | 7.5 | 25.3 | 106.5 | 20.7 | 3.14 | 81.1 | 0.88 | 56.6 | 0.060 | 51.92 | 0.0456 | | |
| F | 17.3 | 31.0 | 106.7 | 19.8 | 3.13 | 82.1 | 0.87 | 55.1 | 0.061 | 51.81 | 0.0413 | | |

Note:
DWS is the dry warm shrinkage.
BOS is the boil off shrinkage.
$E_b$ in Table 2 is elongation at break in %.
T(p1) in Table 2 is the first thermal tension peak temperature.
Tens(p1) is the first peak thermal tension.
Ton is the shrinkage onset temperature.
Tens(130 C.) is the thermal tension at temperature of 130° C.

Discussion of Results—Examples 1–2 and Comparative Examples A, E, and F

As can be seen in Table 2, at a spin speed of 3334 in addition to other conditions per Table 1, annealing at temperatures of 115° C. and higher results in a 3GT yarn resistant to aging as indicate by low DWS values. Examples 1 and 2 and Comparative Examples A, E and F, show the effect of annealing temperature at a spin speed of 3334 m/m. Since Examples 1 and 2 have DWS values less than 4%, the annealing temperatures provided the product yarns with sufficient aging resistance. The annealing temperatures in the Comparative Examples were not sufficient to produce yarns resistant to aging. A sufficient annealing temperature at 3334 m/m and the conditions specified in Table 1, was thereby determined. The tension at 130° C. was greater than about 0.04 g/d for all the examples.

A 2.3 kg, 156 mm diameter yarn package prepared according to Example 1 was monitored for package deformation by exposing to a temperature of 41° C. for 3.2 hours in an air-heated oven. Before exposure, the package dish ratio was 0.15%, and the difference between end and mid package diameter, ED−MD, was 0.4 mm. After exposure for 2.25 hours, the dish ratio was 0.2 about 9%, and ED−MD was 0.7 mm. After exposure for 3.2 hours, the dish ratio was 0.2 about 9%, indicating aging resistance. The dish ratio of a similar yarn package prepared according to Comparative Example A was also monitored upon exposure to 41° C. for 3.2 hours. The dish ratio of this package increased from a value of 0.65 prior to heating to 1.87 after heating, indicating high degree of deformation. The exposure results support DWS values as an accurate predictor of aging resistant in the yarn packages.

Examples 3–5

The process of Examples 1–2 was repeated except that spin speed was 3500 m/m and the second interlace jet had a pressure of 25 psi instead of 35 psi. Other spinning conditions are provided in Table 3. Winding speed was set to achieve the desired winding tension. The properties of the resultant yarns are provided in Table 4.

In these examples a draw ratio of 1 was used. Four heated godet temperatures were tested at 3500 m/m, see Table 3, including Comparative Example B in which no heating was applied during spinning. Compared to Example 1, these examples used a different winding speed in order to achieve the desired winding tension. Examples 3–5 and Comparative Example B use the same polymer throughput as for Example 1. Therefore, the denier of the resultant yarns for Examples 3–5 and Comparative Example B are slightly lower than the denier in Example 1.

TABLE 3

Spinning Conditions for Examples 3–5 and Comparative Example B.

| Example | Turn(G1) (a) | T(G1) ° C. (b) | Turn(G2) (c) | DR (d) | SP(G1) m/m (e) | SP(G2) m/m (f) | SP(WU) m/m (g) | OF(WU) % (h) | Tw g (i) |
|---|---|---|---|---|---|---|---|---|---|
| 3 | 6s7g | 135 | 0s1g | 1.0000 | 3500 | 3500 | 3407 | 1.778 | 3.6 |
| 4 | 6s7g | 125 | 0s1g | 1.0000 | 3500 | 3500 | 3389 | 2.306 | 4.1 |
| 5 | 6s7g | 115 | 0s1g | 1.0000 | 3500 | 3500 | 3389 | 2.306 | — |
| B | 4s5g | rt | 0s1g | 1.0000 | 3500 | 3500 | 3444 | 0.7 | 9.1 |

a) - (i) are the same as for Table 1.

TABLE 4

Yarn Properties of Examples 3–5 and Comparative Example B.

| Example | DWS % | BOS % | Denier | Modulus g/d | Tenacity g/d | $E_b$ % | % U | T(p1) ° C. | Tens(p1) g/d | Ton ° C. | Tens (130° C.) g/d d | Dish ratio, % - before | Dish ratio, % - after |
|---|---|---|---|---|---|---|---|---|---|---|---|---|---|
| 3 | 1.6 | 5.6 | 101.8 | 20.2 | 3.05 | 76.6 | 0.87 | 72.8 | 0.044 | 54.80 | 0.0437 | 0.13 | 0.26 |
| 4 | 2.2 | 6.3 | 103.0 | 20.0 | 3.10 | 80.3 | 0.96 | 70.2 | 0.043 | 54.64 | 0.0416 | | |
| 5 | 3.9 | 11.2 | 102.6 | 20.4 | 3.07 | 79.1 | 0.96 | 60.9 | 0.053 | 53.25 | 0.0424 | | |
| B | 13.7 | 32.2 | 101.7 | 21.4 | 3.14 | 77.6 | 0.85 | 57.6 | 0.071 | 51.60 | 0.0612 | 0.63 | 1.86 |

Discussion of Results—Examples 3–5 and Comparative Example B

As seen in Table 4, DWS decreased as the heated godet temperature increased at spinning speed 3500 m/m. When the heated godet temperature was increased to 135° C. in Example 3, DWS dropped to below about 2% while at 125° C. and at 115° C., DWS was 2. about 2% and 3. about 9%, respectively. Therefore, a temperature of 115° C. is sufficient to provide an aging resistant yarn under these conditions. The tension at 130° C. was also greater than about 0.04 g/d for all the examples.

A 2.7 kg, 164 mm diameter yarn package prepared according to Example 3 was monitored for package deformation by exposing to a temperature of 41° C. for 5.2 hours per Example 1. Before exposure, the package dish ratio was 0.13%, and the difference between end and mid package diameter, ED–MD, was 0.3 mm. After exposure for 3.5 hours, the dish ratio was 0.26%, and ED–MD was 0.7 mm. After exposure for 5.2 hours, the dish ratio was 0.25%, and ED–MD was 0.6 mm, indicating aging resistance. The dish ratio of a similar yarn package, prepared according to Comparative Example B, was also monitored upon treatment at 41° C. for 5.2 hours. The dish ratio of this package increased from a value of 0.63 prior to heating to 1.86 after heating, indicating high degree of deformation. The exposure results support DWS values as an accurate predictor of aging resistant in the yarn packages.

Examples 6–8

The process of Examples 1–2 was repeated except that spin speed was 3800 m/m and the second interlace jet had a pressure of 25 psi instead of 35 psi. Spinning parameters are provided in Table 5. Winding speed was set to achieve the desired winding tension. The properties of the resultant yarns are provided in Table 6.

TABLE 5

Spinning Conditions for Examples 6–8 and Comparative Example C.

| Example | Turn(G1) (a) | T(G1) ° C. (b) | Turn(G2) (c) | DR (d) | SP(G1) m/m (e) | SP(G2) m/m (f) | SP(WU) m/m (g) | OF(WU) % (h) | Tw g (i) |
|---|---|---|---|---|---|---|---|---|---|
| 6 | 6s7g | 135 | 0s1g | 1.0000 | 3800 | 3800 | 3721 | 1.2 | 5.3 |
| 7 | 6s7g | 125 | 0s1g | 1.0000 | 3800 | 3800 | 3721 | 1.2 | 5.4 |
| 8 | 6s7g | 115 | 0s1g | 1.0000 | 3800 | 3800 | 3721 | 1.2 | 5.8 |
| C | 4s5g | 30 | 0s1g | 1.0000 | 3800 | 3800 | 3732 | 0.9 | 8.6 |

(a) - (i) are the same as for Table 1.

TABLE 6

Yarn Properties of Examples 6–8 and Comparative Example C.

| Example | DWS % | BOS % | Denier | Modulus g/d | Tenacity g/d | $E_b$ % | % U | T(p1) ° C. | Tens(p1) g/d | Ton ° C. | Tens (130° C.) g/d | Dish ratio, % - before | Dish ratio, % - after |
|---|---|---|---|---|---|---|---|---|---|---|---|---|---|
| 6 | 1.3 | 6.8 | 93.5 | 21.0 | 3.19 | 71.8 | 0.86 | 78.8 | 0.070 | 54.72 | 0.0717 | 0.25 | 0.38 |
| 7 | 2.1 | 8.4 | 93.5 | 20.9 | 3.18 | 72.3 | 0.87 | 74.6 | 0.073 | 54.02 | 0.0743 | | |
| 8 | 3.4 | 10.2 | 93.5 | 21.0 | 3.11 | 70.8 | 0.85 | 71.7 | 0.074 | 53.83 | 0.0716 | | |
| C | 9.1 | 23.7 | 94.1 | 21.9 | 3.16 | 72 | 0.81 | 61.6 | 0.080 | 52.26 | 0.0784 | 0.52 | 1.76 |

Discussion of Results—Examples 6–8 and Comparative Example C

As can be seen in Tables 5 and 6, under the conditions of Examples 6–8 at temperatures on the heated godet of 115° C. or higher, DWS values were all less than 4%, indicating aging resistance.

A 2.7 kg, 160 mm diameter yarn package prepared according to Example 6 was monitored for package deformation by exposing to a temperature of 41° C. for 5.2 hours per Example 1. Before exposure, the package dish ratio was 0.25%, and the difference between end and mid package diameter, ED–MD, was 0.6 mm. After exposure for 3.5 hours, the dish ratio was 0.2 about 9%, and ED–MD was 0.7 mm. After exposure for 5.2 hours, the dish ratio was 0.38%, and ED–MD was 1 mm, indicating aging resistance. These changes in the package show good resistance to aging, confirming prediction by DWS. The dish ratio of a similar yarn package, prepared according to Comparative Example C, was also monitored upon treatment at 41° C. for 5.2 hours. The dish ratio of this package increased from a value of 0.52 prior to heating to 1.76 after heating, indicating high degree of deformation. The exposure results support DWS values as an accurate predictor of aging resistant in the yarn packages.

Due to the increased spinning speed and reduced denier per filament compared to Example 1, the elongation values of the yarns produced in Examples 6–8 and Comparative Example C were reduced to about 71% compared to about 80% at spinning speed 3334 m/m. No significant change in modulus or tenacity occurred from increasing spinning speed from 3334 to 3800 m/m.

Examples 9–12

The process of Examples 1–2 was repeated with a spin speed of 4000 m/m and the second interlace jet had a pressure of 25 psi instead of 35 psi. Spinning parameters are provided in Table 7. Winding speed was set to achieve the desired winding tension. The properties of the resultant yarns are provided in Table 8.

TABLE 7

Spinning Conditions for Examples 9–12 and Comparative Example D.

| Example | Turn(G1) (a) | T(G1) ° C. (b) | Turn(G2) (c) | DR (d) | SP(G1) m/m (e) | SP(G2) m/m (f) | SP(WU) m/m (g) | OF(WU) % (h) | Tw g (i) |
|---|---|---|---|---|---|---|---|---|---|
| 9 | 6s7g | 145 | 0s1g | 1.0000 | 4001 | 4001 | 3913 | 1.3 | 5.3 |
| 10 | 6s7g | 135 | 0s1g | 1.0000 | 4001 | 4001 | 3913 | 1.3 | 5.6 |
| 11 | 6s7g | 125 | 0s1g | 1.0000 | 4001 | 4001 | 3913 | 1.3 | 5.6 |
| 12 | 6s7g | 115 | 0s1g | 1.0000 | 4001 | 4001 | 3913 | 1.3 | 6 |
| D | 4s5g | 30 | 0s1g | 1.0000 | 4001 | 4001 | 3921 | 1.1 | 8.6 |

(a) - (i) are the same as for Table 1.

TABLE 8

Yarn Properties of Examples 9–12 and Comparative Example D.

| Example | DWS % | BOS % | Denier | Modulus g/d | Tenacity g/d | $E_b$ % | % U | T(p1) ° C. | Tens(p1) g/d | Ton ° C. | Tens (130° C.) g/d | Dish ratio, % - before | Dish ratio, % - after |
|---|---|---|---|---|---|---|---|---|---|---|---|---|---|
| 9 | 1.6 | 5.9 | 89.3 | 21.7 | 3.25 | 70.8 | 0.87 | 87.8 | 0.067 | 58.75 | 0.0726 | 0.18 | 0.44 |
| 10 | 2 | 6.6 | 89.1 | 20.9 | 3.22 | 71.5 | 0.90 | 75.8 | 0.076 | 53.74 | 0.0749 | | |
| 11 | 2.5 | 7.5 | 89 | 20.8 | 3.11 | 69.1 | 0.89 | 67.8 | 0.091 | 53.70 | 0.0860 | | |
| 12 | 3.7 | 9.5 | 88.9 | 20.6 | 3.20 | 70.4 | 0.86 | 70.3 | 0.089 | 54.27 | 0.0842 | | |
| D | 7.6 | 14.4 | 89.4 | 21.5 | 3.19 | 71.5 | 0.77 | 62.6 | 0.088 | 52.64 | 0.0770 | 0.53 | 1.52 |

Discussion of Results—Examples 9–12 and Comparative Example D

As can be seen from Tables 7 and 8, as the heated godet temperature increased, DWS of the resultant yarns decreased. When the heated godet temperature was at 115° C. or 125° C., the DWS of the resultant yarn was between 2 and 4%. Therefore, 115° C. and 125° C. are both accept able temperatures for annealing at spinning speed of 4000 m/m to produce aging resistant yarns. Lower DWS values were achieved at higher temperatures.

A 2 kg, 152 mm diameter yarn package prepared according to Example 10 was monitored for package deformation by exposing to a temperature of 41° C. for 3.4 hours, per Example 1. Before exposure, the package dish ratio was 0.18%, and the difference between end and mid package diameter, ED−MD, was 0.64 mm. After exposure for 3.4 hours, the dish ratio was 0.44%, and ED−MD was 1.1 mm. These changes in the package show good resistance to aging, confirming prediction by DWS. The dish ratio of a similar yarn package, prepared according to Comparative Example D, was also monitored upon treatment at 41° C. for 3.4 hours. The dish ratio of this package increased from a value of 0.53 prior to heating to 1.52 after heating, indicating high degree of deformation. The exposure results support DWS values as an accurate predictor of aging resistant in the yarn packages.

Examples 13–16 and Comparative Examples G–I

The process of Examples 1–2 was repeated except for those parameters identified in Table 9 and those discussed herein. The 3GT polymer had an I.V. of 1.02. The spinneret temperature was 264° C. The spinning speed applied was 3500 m/m. The second interlace jet had a pressure of 35 psi. The draw ratio varied from 0.999 to 1.10. In order to evaluate the existence of tube crushing, packages at size of about 2.5 kg and about 160 mm in package diameter were made for all examples and comparative example given in Table 9. The properties of the resultant yarns are provided in Table 10.

Discussion of Results for Examples 13–16 and Comparative Examples G–I

Table 10 shows that the DWS increases as draw ratio increased. At draw ratio 1.10, the DWS is slightly higher than 4%. Although, at a draw ratio of 1.08, DWS was only 3.4%, which indicates aging resistance at these conditions, at draw ratios greater than 1.04, tube crushing occurred. Therefore from the standing point of aging resistance during yarn storage, increase draw ratio in spin annealing process does not dramatically weaken aging resistance of the yarn. However tube crushing occurs during package winding, which prevents the package from being taken off from spindles on winders. Table 10 also shows that the elongation of the resultant yarn decreases as draw ratio increases. At draw ratio 1.04 at which the tube crushing is about to occur, the elongation reduced to about 66% from above 70% at draw ratio equal to or less than 1. Elongation of the resultant yarn is further reduced when draw ratio further increases from 1.04. Decrease in elongation in DTY feed yarn decreases spinning productivity. Therefore from a productivity point of view, a low draw ratio is also desired.

Examples 17–20

The process of Examples 1–2 was repeated except for those parameters identified in Table 11. The properties of the resultant yarns are provided in Table 12 and compared with the properties of Examples 1, 3, 6, and 9.

Examples 17–20 together with Examples 1, 3, 6 and 9 provide examples of changing draw ratio at spinning speeds 3334, 3500, 3800 and 4000 m/m. Key process conditions are provided in Table 11. Draw ratios were all equal to or less

TABLE 9

Spinning Conditions for Examples 13–16 and G–I.

| Example | Turn(G1) (a) | T(G1) ° C. (b) | Turn(G2) (c) | DR (d) | SP(G1) m/m (e) | SP(G2) m/m (f) | SP(WU) m/m (g) | OF(WU) % (h) | Tw g (i) |
|---|---|---|---|---|---|---|---|---|---|
| 13 | 6s7g | 135 | 3s4g | 0.999 | 3500 | 3823 | 3761 | 0.90 | 5.7 |
| 14 | 6s7g | 135 | 3s4g | 1.000 | 3500 | 3828 | 3765 | 0.90 | 5.5 |
| 15 | 6s7g | 135 | 3s4g | 1.020 | 3500 | 3905 | 3841 | 0.90 | 5.6 |
| 16 | 6s7g | 135 | 3s4g | 1.040 | 3500 | 3981 | 3912 | 1.00 | 5.6 |
| G | 6s7g | 135 | 3s4g | 1.060 | 3500 | 4058 | 3987 | 1.00 | 5.7 |
| H | 6s7g | 135 | 3s4g | 1.080 | 3500 | 4134 | 4056 | 1.00 | 7.6 |
| I | 6s7g | 135 | 3s4g | 1.100 | 3500 | 4211 | 4131 | 1.00 | 9.5 |

(a) - (i) are the same as in Table 1.

TABLE 10

Yarn Properties for Examples 13–16 and G–I.

| Example | DWS % | BOS % | Denier | Modulus g/d | Tenacity g/d | $E_b$ % | % U | T(p1) ° C. | Tens(p1) g/d | Ton ° C. | Tens (130° C.) g/d | Crushed Tube |
|---|---|---|---|---|---|---|---|---|---|---|---|---|
| 13 | 1.5 | 9.3 | 103.1 | 19.8 | 2.97 | 72.5 | 0.72 | 71.0 | 0.056 | 51.1 | 0.0572 | No |
| 14 | 1.8 | 8.3 | 102.4 | 19.7 | 3.06 | 75.7 | 0.72 | 71.5 | 0.055 | 51.5 | 0.0566 | No |
| 15 | 2.5 | 9.3 | 100.7 | 20.8 | 3.00 | 69.1 | 0.67 | 74.0 | 0.094 | 49.9 | 0.0914 | No |
| 16 | 2.6 | 11.2 | 99.0 | 21.5 | 3.07 | 65.8 | 0.66 | 88.1 | 0.128 | 49.8 | 0.1240 | No |
| G | 2.7 | 11.7 | 98.5 | 22.8 | 3.28 | 65.6 | 0.66 | 87.5 | 0.158 | 49.8 | 0.1514 | Yes |
| H | 3.3 | 12.4 | 96.7 | 22.7 | 3.33 | 63.7 | 0.66 | 90.7 | 0.194 | 50.7 | 0.1857 | Yes |
| I | 4.2 | 11.6 | 94.4 | 22.7 | 3.45 | 61.1 | 0.72 | 100.8 | 0.221 | 50.1 | 0.2148 | Yes |

than 1. Heated godet temperatures were the same for the two examples compared at each spinning speed. The windup overfeed was adjusted for each example in order to reach a desired winding tension. The effect of draw ratio is compared at each spinning speed. When spinning speed changed between Examples 1 and 17, Examples 3 and 18, Examples 6 and 19 and Examples 9 and 20, the polymer throughput was maintained at the value provided in Example 1. Therefore, the denier decreased as spinning speed increased.

TABLE 11

Spinning Conditions for Examples 1, 6, 9, and 17–20.

| Example | Sprt T ° C. (a') | Turn(G1) (a) | T(G1) ° C. (b) | Turn(G2) (c) | DR (d) | SP(G1) m/m (e) | SP(G2) m/m (f) | SP(WU) m/m (g) | OF(WU) % (h) | Tw g (i) |
|---|---|---|---|---|---|---|---|---|---|---|
| 1 | 264 | 6s7g | 135 | 3s4g | 0.9989 | 3334 | 3330 | 3270 | 0.900 | 5.4 |
| 17 | 262 | 6s7g | 135 | 0s1g | 1.0000 | 3334 | 3334 | 3274 | 0.916 | 4.9 |
| 18 | 264 | 6s7g | 135 | 3s4g | 0.9989 | 3500 | 3496 | 3434 | 0.900 | 6.5 |
| 3 | 262 | 6s7g | 135 | 0s1g | 1.0000 | 3500 | 3500 | 3407 | 1.778 | 3.6 |
| 19 | 264 | 6s7g | 135 | 3s4g | 0.9989 | 3800 | 3796 | 3717 | 1.187 | 6.5 |
| 6 | 262 | 6s7g | 135 | 0s1g | 1.0000 | 3800 | 3800 | 3721 | 1.200 | 5.3 |
| 20 | 264 | 6s7g | 145 | 3s4g | 0.9989 | 4001 | 3996 | 3913 | 1.187 | 6.4 |
| 9 | 262 | 6s7g | 145 | 0s1g | 1.0000 | 4001 | 4001 | 3913 | 1.300 | 5.3 |

(a) - (i) are the same as for Table 1.
(a') Spinneret temperature

TABLE 12

Yarn Properties for Examples 1, 6, 9, and 17–20.

| Example | DWS % | BOS % | Denier | Modulus g/d | Tenacity g/d | $E_b$ % | % U | Tens T(p1) ° C. | (p1) g/d | Ton ° C. | Tens (130° C.) g/d | Package Weight kg | End Diameter mm | Bulge Ratio % | Dish Ratio % |
|---|---|---|---|---|---|---|---|---|---|---|---|---|---|---|---|
| 1 | 1.5 | 5.75 | 106.4 | 20.8 | 3.02 | 79.5 | 0.83 | 77.6 | 0.042 | 57.18 | 0.0429 | 16.7 | 319.4 | 3.34 | 0.13 |
| 17 | 2.4 | 6.0 | 107.8 | 19.6 | 2.94 | 79.2 | 0.90 | 70.0 | 0.049 | 54.88 | 0.0448 | — | — | — | — |
| 18 | 1.1 | 6.0 | 101.5 | 20.5 | 3.13 | 76.0 | 0.83 | 74.7 | 0.048 | 54.50 | 0.0491 | 16.7 | 321.3 | 4.73 | 0.25 |
| 3 | 1.6 | 5.6 | 101.8 | 20.2 | 3.05 | 76.6 | 0.87 | 72.8 | 0.044 | 54.80 | 0.0437 | — | — | — | — |
| 19 | 1.1 | 6.1 | 93.9 | 21.3 | 3.20 | 72.2 | 0.80 | 74.6 | 0.064 | 54.74 | 0.0670 | 16.7 | 323.1 | 6.10 | 0.38 |
| 6 | 1.3 | 6.8 | 93.5 | 21.0 | 3.19 | 71.8 | 0.86 | 78.8 | 0.070 | 54.72 | 0.0717 | — | — | — | — |
| 20 | 1.0 | 6.2 | 89.1 | 20.5 | 3.22 | 70.0 | 0.88 | 80.8 | 0.076 | 56.27 | 0.0798 | 9.3 | 253.5 | 5.92 | 0.04 |
| 9 | 1.6 | 5.9 | 89.3 | 21.7 | 3.25 | 70.8 | 0.87 | 87.8 | 0.067 | 58.75 | 0.0726 | — | — | — | — |

Discussion of Results Examples 17–20

As can be seen from Table 12, at each spinning speed examined, DWS was higher at the higher draw ratio. This effect was more evident at low spinning speed. At 3334 m/m, when the draw ratio changed from 0.9989 to 1, DWS increased from 1.5 to 2.4%. Other yarn properties are quite similar at each spinning speed when draw ratio changes from 0.9989 to 1, especially BOS, which changes less than DWS. Table 12 also gives four examples of package winding in SAY spinning of this invention. Examples 1, 18, 19, and 20 give package winding at spinning speed 3334, 3500, 3800 and 4000 m/m respectively. The package weight, package end diameter, bulge ratio and dish ratio of the obtained packages are shown in Table 12. Surprisingly, the package size in Examples 1, 18, and 19 reaches 16.7 kg.

One of ordinary skill in the art, having the benefit of the present disclosure, will appreciate the many advantages and features of the present invention and that many modifications may be made to the various aspects and embodiments of the present invention as described herein without departing from the spirit of the present invention. For example, Yarns for textile applications must have certain properties, such as sufficient tenacity and proper elongation, with sufficiently low shrinkage to be suitable for use in textile processes, such as weaving and knitting. Existing commercially available 3GT yarns are partially-oriented poly(trimethylene terephthalate) yarns (3GT POY), which need to be drawn or draw-textured before use in fabrics. Processes in accordance with the present invention, among other things, provides a "direct-use" spun yarn, which may be used to make textile products without further drawing. Also for example, designing a spinning process to improve aging resistance in a yarn package should be based on actual package aging. However, measuring actual aging of a package is very time consuming. One aspect of the present invention provides for a method that can predict aging of a package that can be quickly and easily performed. The various aspects and embodiments described herein are, accordingly, illustrative only and are not intended to limit the scope of the present invention.

What is claimed is:

1. A process comprising:

(a) extruding melted 3GT through a spinneret;

(b) quenching the extruded 3GT to form a threadline of solid filaments wherein the filaments have a tension at 130° C. greater than about 0.02 g/d;

(c) passing the filaments to a heated godet operated at a speed and temperature to heat the threadline wherein the speed and temperature to which the threadline is heated are sufficient to provide a yarn with a DWS value of about 4% or less; and (d) cooling the yarn to a temperature of about 35° C. or less.

2. The process of claim 1, wherein a finish is applied to the solid filaments after quenching.

3. The process of claim 1, wherein the cooling is accomplished using a cool godet.

4. The process of claim 3, wherein the speed of the cool godet provides a draw ratio between the heated godet and the cool godet of about 1.04 or less.

5. The process of claim 3, wherein the threadline from the cool godet is wound on a package.

6. The process of claim 5, wherein the winding is such that the true yarn speed is less than the speed of the cool godet.

7. The process of claim 3, wherein the threadline tension is increased before passing to the cool godet.

8. The process of claim 7, wherein the threadline tension is increased by at least about 0.005 g/d.

9. The process of claim 8, wherein the threadline tension is increased by at least about 0.010 g/d.

10. The process of claim 9, wherein the threadline tension is increased by at least about 0.015 g/d.

11. The process of claim 3, wherein the speed of the heated godet is at least about 3000 m/m.

12. The process of claim 11, wherein the temperature of the heated godet is about 90° C. to about 165° C.

13. The process of claim 12, wherein the temperature of the heated godet is about 115° C. to about 160° C.

14. The process of claim 13, wherein the temperature of the heated godet is about 125° C. to about 155° C.

15. The process of claim 4, wherein the draw ratio between the heated godet and the cool godet is less than about 1.02.

16. The process of claim 15, wherein the draw ratio is about 1.0 or less.

17. The process of claim 5, wherein the filaments are wound on a package at a tension greater than about 0.04 g/d.

18. The process of claim 17, wherein the filaments are wound at a tension greater than about 0.05 g/d.

19. The process of claim 17, wherein the filaments are wound at a tension less than about 0.12 g/d.

20. The process of claim 19, wherein the filaments are wound at a tension less than about 0.10 g/d.

21. The process of claim 17, wherein the filaments are wound at a tension less than about 0.08 g/d.

22. The process of claim 20, wherein the filaments are wound at a tension less than about 0.08 g/d.

* * * * *